US006386190B1

(12) United States Patent
Kurtz, Jr.

(10) Patent No.: US 6,386,190 B1
(45) Date of Patent: May 14, 2002

(54) BOW PRESS

(76) Inventor: Gerald Kurtz, Jr., 245 Beshore School Rd., Manchester, PA (US) 17345

( * ) Notice: Subject to any disclaimer, the term of this patent is extended or adjusted under 35 U.S.C. 154(b) by 0 days.

(21) Appl. No.: 09/765,284

(22) Filed: Jan. 22, 2001

Related U.S. Application Data

(60) Provisional application No. 60/204,598, filed on May 16, 2000.

(51) Int. Cl.[7] ..... F41B 5/14
(52) U.S. Cl. ..... 124/1; 124/86
(58) Field of Search ..... 124/1, 23.1, 86

(56) References Cited

U.S. PATENT DOCUMENTS 5,222,473 A * 6/1993 Lint ..... 124/86
5,370,103 A * 12/1994 Sesselle ..... 124/86
5,433,186 A * 7/1995 Corwin ..... 124/86
5,983,879 A * 11/1999 Gifford ..... 124/1
6,220,235 B1 * 4/2001 Sands ..... 124/1

* cited by examiner

*Primary Examiner*—John A. Ricci
(74) *Attorney, Agent, or Firm*—Rodger H. Flagg

(57) ABSTRACT

A bow press for use in stringing or repairing bows, including compound bows, has a riser operated by a winch mechanism. The bow press includes a riser bar for supporting an inclined riser beam having spaced apertures for positioning two handle rollers thereon. Left and right inclined spacer bars each support a limb roller thereon. Each of the handle rollers and limb rollers includes an axle, and two spaced portions defining an inclined groove therebetween. The inclined groove receives a portion of a bow to support the bow during stringing or re-stringing operations. The riser bar is adjustably movable upwards and downwards by operation of a winch. The base member adjustably supports left and right spacer bars. The left and right spacer bars are adjusted along the base member, and secured in position by respective tensioning members. The base member is a table or other support surface. Alternately, the base member is attached to upstanding leg members, which support the bow press upon the floor.

20 Claims, 2 Drawing Sheets

BOW PRESS

This application claims priority from provisional application Ser. No. 60/204,598, filed May 16, 2000.

FIELD OF THE INVENTION

The present invention relates to bow presses. More particularly, the invention relates to a bow press for use in stringing or repairing bows, including compound bows, and has a riser operated by a jack mechanism. The jack mechanism may be manually or electrically actuated. The present invention provides a durable, relatively inexpensive, easily implemented system for maintaining and servicing a variety of types and configurations of bows in a safe and effective manner.

BACKGROUND OF THE INVENTION

The prior art includes various types of devices to permit servicing of bows. Such devices generally include a support for the solid parts of the bow, and may include elements for handling the bow string.

U.S. Pat. No. 5,370,103 to Desselle (the entire disclosure of which is hereby incorporated herein by reference) is an example of such a device. In this device, a stand tube is provided having an upper end which supports a jack. A crank is provided for the jack. The jack causes up and down movement of a riser bar. The riser bar is affixed to a riser beam, and a pair of riser rollers are slideably affixed to the riser bar. In this device, the riser beam is generally flat and straight, and the riser rollers are clampingly secured to the riser bar. The rollers of the riser beam are slideably mounted thereon, and can be secured manually by an adjusting mechanism. The riser beam is used to pull down the center of a bow, and thus allows the bow to be strung or re-strung, for example. However, in this type of bow press, it is possible for the rollers on the riser beam to slip along the riser beam when under sufficient stress or force. Also, due to the flat shape of the riser beam, there can be interference with various types of attachments on some bows, thereby preventing adjustment.

U.S. Pat. No. 5,433,186 to Corwin teaches a bow press and a method for compressing bows. In this device, a bow press is used to crank up a bent bar that has rollers on the end thereof, permitting stringing of a bow.

U.S. Pat. No. 5,222,473 to Lint discloses a bow press having a hydraulic actuating mechanism. It includes a hinged bar to bend up the ends of the bow.

U.S. Pat. No. 3,055,655 to Chelf discloses a device for stringing archery bows. This device holds both ends of the bow, using notches and grooves to move the supports, and thus strings the bow.

SUMMARY OF THE INVENTION

From the foregoing, it is seen that it is a problem in the art to provide a device meeting the above requirements. According to the present invention, a device is provided which meets the aforementioned requirements and needs in the prior art. Specifically, the device according to the present invention provides a durable, relatively inexpensive, bow press, which is easy to use, for maintaining and servicing a variety of types and configurations of bows in a safe and effective manner.

The bow press includes an inclined riser beam having spaced apertures for receiving the axles of rollers, and has a left and right inclined ends. The riser beam supports two rollers in spaced relationship. Each roller includes an axle. Each roller has two inclined portions defining an inclined groove therebetween. The inclined groove supports a portion of a bow during stringing, re-stringing or repair operations.

A substantially vertical riser bar supports the inclined riser beam. The riser bar is adjustably movable upwards and downwards by operation of a jack mechanism. The jack mechanism is supported by a base member. The base member also supports left and right inclined spacer bars, which are adjustably secured on either side of the riser bar. Each of the left and right inclined spacer bars supports a limb roller thereon. The left and right spacer bars, once adjusted along the base member, are secured in position thereon by respective tensioning members. The base member includes left and right mounting portions for securing the base member to a table or other support. The base member may also be attached to upstanding leg members, so that the upstanding leg members can be used to directly support the bow press above a floor or work area.

The jack mechanism to raise and lower the vertical riser bar may be manually actuated, or electrically actuated with a motor and switch.

Other objects and advantages of the present invention will be more readily apparent from the following detailed description when read in conjunction with the accompanying drawings.

DETAILED DESCRIPTION OF THE INVENTION

Figure 1:
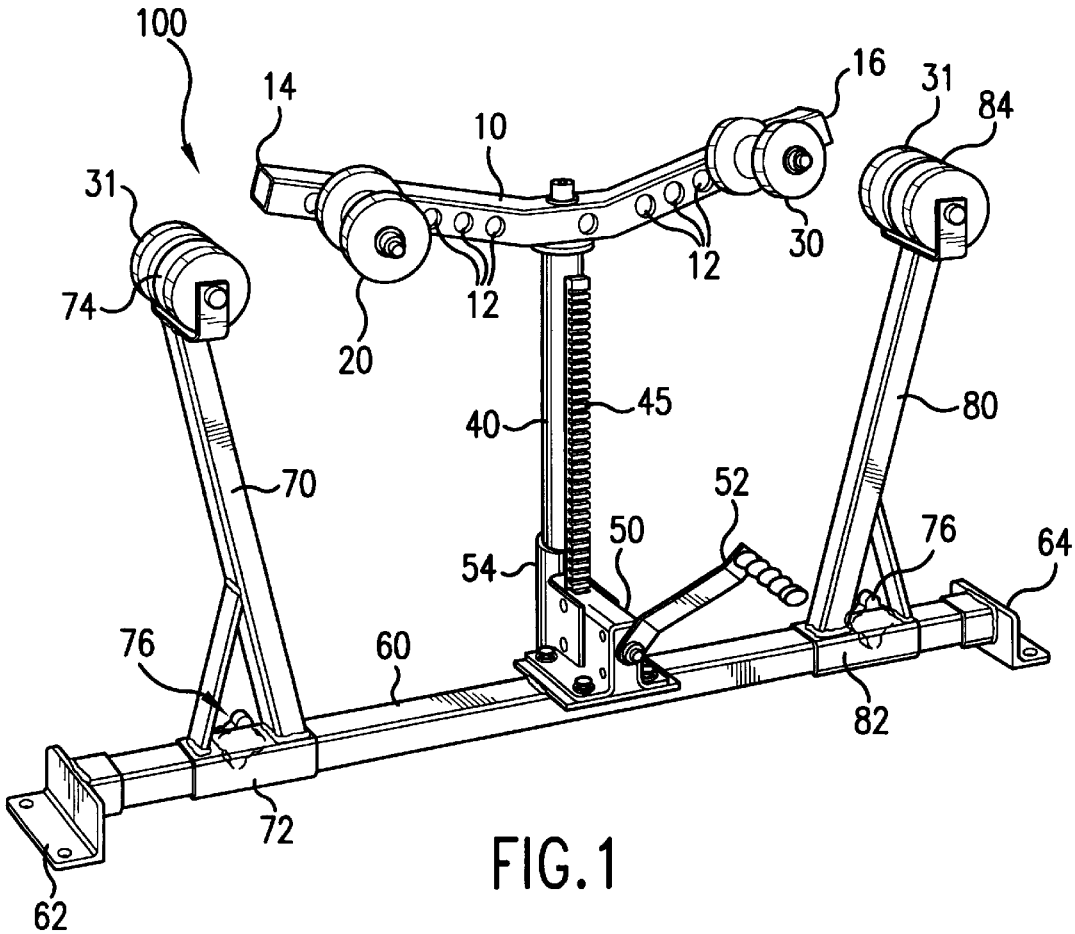
FIG. 1 is a perspective view of a table mounted bow press according to the present invention, shown with a manually actuated jack mechanism.
Figure 2:
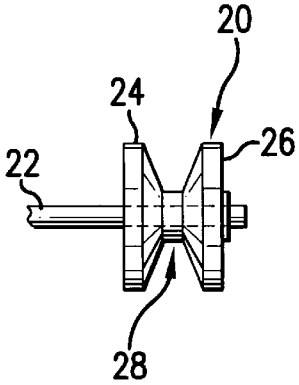
FIG. 2 is a side elevational view of a limb roller or a handle roller used in the device of FIG. 1.
Figure 3:
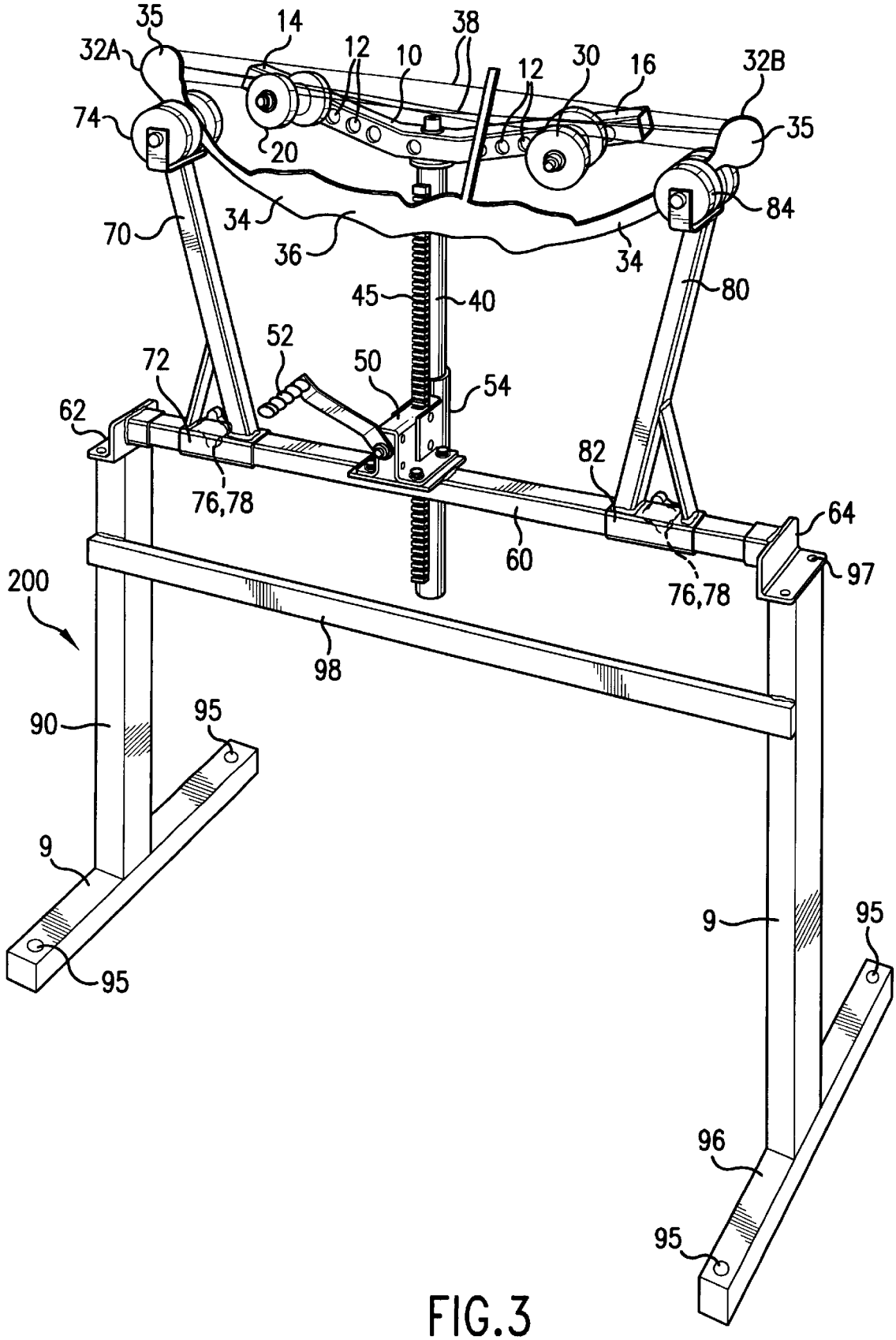
FIG. 3 is a perspective view of the bow press having a bow press stand, according to the present invention.

A bow press 100 according to the present invention, is shown in FIG. 1 through FIG. 3. The bow press 100 provides a durable, relatively inexpensive, easily implemented system for maintaining and servicing a variety of types and configurations of bows in a safe and effective manner.

The bow press 100 includes an inclined riser beam 10 having spaced apertures 12 for receiving axles 22 (shown in FIG. 2) of first and second handle rollers 20 and 30. The inclined riser beam 10 is generally inclined in an obtuse V-shape, to eliminate interference with various types of attachments on some bows, such as bow sights, stabalizing bars, etc.

The inclined riser beam 10 of the present invention includes an inclined left end 14 and an inclined right end 16, each having a plurality of spaced apertures 12 therein. The spaced apertures 12 in the inclined riser beam 10 adjustably positions and supports the axle 22 of the first and second handle rollers 20 and 30 therein.

The first handle roller 20, as shown in FIG. 2, includes an axle 22 which is receivable in any of the spaced apertures 12 located on the inclined riser beam 10. The first handle roller 20 also includes two inclined, spaced inclined portions 24, 26 defining an inclined groove 28 therebetween. In operation, the inclined groove 28 receives a portion of a bow handle to support the bow handle portion 36 during stringing, re-stringing and maintenance operations. The second handle roller 30 is substantially identical to the first handle roller 20, and is therefore not further described herein.

The use of spaced apertures 12 to adjustably position the axles 22 of the first and second handle rollers 20 and 30 is significant in preventing problems encountered by the prior art. In one type of prior art device, the rollers of the riser beam are slideably mounted thereon. In this type of bow press, it is possible for the rollers on the riser beam to slip along the riser beam, when pressing certain bow configurations, causing a safety hazard to the operator and/or damage to the pressed bow.

Thus, the present invention provides a significant improvement over slideably mounted handle rollers used on prior art equipment. The first and second handle rollers 20, 30 are easily positioned and placed in a suitable aperture 12, to enable safe, secure and adjustable bow 32 mounting. This bow press 100 is adaptable to a large variety of bow types and sizes, including compound bows, single and double cam bows, junior size bows, and crossbows.

A substantially vertical riser bar 40 movably and adjustably supports the inclined riser beam 10. The riser bar 40 is adjustably movable upwards and downwards by operation of a jack mechanism 50 having at least one gear 45. The jack mechanism 50 may be either manually actuated, or electrically actuated with the aid of a reversible electric motor 56 and a control switch 58. The jack mechanism 50 will maintain its position while under pressure without locking-up. The manual jack mechanism 50 preferably utilizes a worm gear 45, and does not require the holding of the crank handle 52 during use. The riser bar 40 has a plurality of vertically aligned teeth 48 thereon, for engagement with the gear 45 in the jack housing 54. The manual jack mechanism 50 shown in FIG. 1, includes a manual crank handle 52 and a jack housing 54. The jack mechanism 50 has gear teeth 48 which engage the teeth 45 on the riser bar 40. The jack mechanism 50 is similar to a manual gear driven automobile jack having a rotatable jack handle 52. Where the jack mechanism 50 is a manual jack driven by a jack handle 52, the gear 45 is preferably a worm gear.

The jack mechanism 50 may alternately be equipped with a reversible electric motor 56 and an control switch mechanism 58, to controllably power the vertical riser bar 40 up and down. The control switch mechanism 58 is preferably an on/off switch. The motor 56 and switch 58 are connected by insulated electric wire to a remote power source (not shown). See FIG. 4.

The worm gear jack mechanism 50 is affixed to a base member 60. The base member 60 thereby supports the riser bar 40 for movement upward and downward relative to the base member 60. The base member 60 is a relatively straight, flat beam, and includes a left mounting portion 62 and a right mounting portion 64. The left mounting portion 62 and the right mounting portion 64 are used to affix or mount the base member 60 to a table or other raised work surface (not shown). A table aperture (not shown) is aligned in relation to the riser bar 40, so that the riser bar 40 may extend below the work surface into the table aperture, as the inclined riser beam 10 is lowered.

The base member 60 also slideably supports a left inclined spacer bar 70 and a right inclined spacer bar 80 on opposing sides of the riser bar 40. The left inclined spacer bar 70 is secured to a slidable base portion 72 which substantially surrounds the base member 60, and is adjustably secured to the tensioning member 76. The left inclined spacer bar 70 carries a first limb roller 74 at the upper end thereof. The tensioning member 76 is used to releasably secure the base portion 72 in position on the base member 60. For example, the tensioning member 76 can be a handle 78 with a threaded portion extending from the handle 78. The threaded portion is threadably received in complimentary threads extending through a side of the base portion 72. The handle 78 is turned to selectively apply force against the base member 60 so as to frictionally engage the left spacer bar 70 in position along the base member 60. Other types of fixing mechanisms can also be employed, such as: a cam surface, a ratchet-and-notch engagement, a spring-loaded engagement, and so on. Such variations are contemplated as being within the scope of the present invention.

A right inclined spacer bar 80 is also slidably affixed to the base member 60, in the same manner as the left spacer bar 70. The right inclined spacer bar 80 includes a slidable base portion 82 which is slidably received upon the base member 60. The slidable base portion 82 is releasably secured to the base member 60 with a suitable tensioning member 64. A second limb roller 84 is rotatably received upon an upper portion of the right spacer bar 80. The first and second limb rollers 74 and 84 are adjustably positioned for engagement with the limb portions 34 of a selected user's bow 32. Extra wide first and second limb rollers 74, 84 are preferably used to accommodate wide split limb type bows 32. The inclined handle groove 28 will support a variety of sizes of bow limbs 34.

Roller boots 31 may be installed on the first and second limb rollers 74, 84 to cushion and protect the bow 32 from damage or discoloration during use. The first and second limb rollers 74, 84 may be similar in size, structure and shape to the first and second handle rollers and 30. Such variations are contemplated as being within the scope of the present invention.

FIG. 2 is a side elevational view of a first handle roller 20 used in the device of FIG. 1. The first handle roller 20, includes an axle 22 which is rotatably received in any of the spaced apertures 12 of the riser beam 10. The first handle roller 20 can easily be inserted into, and removed from, any of the apertures 12 in the inclined riser beam 10, without tools. The second handle roller 30 is substantially identical to the first handle roller 20, and is therefore not further described herein.

FIG. 3 is a schematic view of the bow press 100 having a stand 200, according to the present invention. The portion above the base member 60 is essentially identical to that shown in FIGS. 1 and 2.

The base member 60 is secured to the first and second upstanding leg members 90 and 92, with a suitable fastening means 97. The first upstanding leg member 90 has a leg base portion 94, and the second upstanding leg member 92 also has a second leg base portion 96. A cross brace 98 may be secured to the first and second upstanding leg members 90, 92 to further stabilize the first and second leg members 92, 94.

As shown in FIG. 3, the cross brace 98 is preferably installed in spaced relation between the base member 60 and the first and second leg base portions 94, 96. Thus, the upstanding leg members 90 and 92 can be used to directly support the bow press 200 upon a floor or work area. Preferably, mounting apertures 95 are provided in the first and second leg base portions 94, 96 to secure the leg base portions to the floor with a suitable fastening means 97.

Thus, in this embodiment, the first and second upstanding leg members 90, 92 support the bow press 200 above the floor.

The bow press 100 described herein, is used as follows: The inclined, left and right spacer bars 70, 80 are slidably positioned on the base member 60 to suit the size and shape of the limbs of the user's bow 32 to be inserted into the bow press 100. Once the limb rollers 74, 84 are positioned to avoid direct contact with wheels, cams, and other bow end apparatus 35, the left and right spacer bars 70, 80 are releasably secured to the base member 60 with a suitable tensioning member 76.

Opposing bow arms 34 are then placed upon the inclined groove 28 of the first and second limb rollers 74 and 84, where the bow 32 is supported in preparation for pressing.

Figure 4:
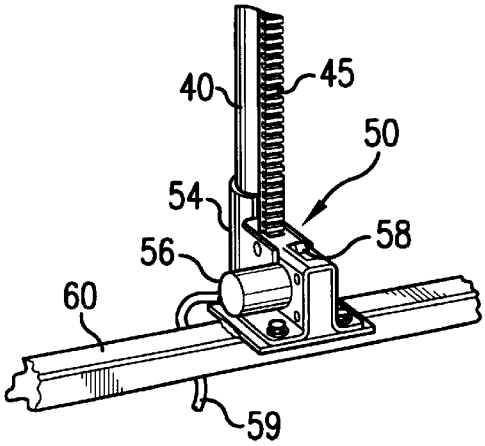
FIG. 4 is a partial view of the jack mechanism powered by a reversible electric motor, with a control switch secured to the jack housing.

The first and second handle rollers 20, 30 are then positioned in selected apertures 12 in the inclined riser beam 10, in alignment with the handle portion 36 of the bow 32. Care is taken to position the first and second handle rollers 20, 30 to avoid contact with sighting and stabilizing apparatus mounted to the handle region of the bow 32. The inclined riser beam 10 with first and second handle rollers 20, 30 is then lowered by rotating the jack mechanism 50 to lower the riser bar 40 until contact is made with the handle portion 36 of the bow 32. This can be accomplished manually by rotating the handle 52, shown in FIG. 1. Alternately, the vertical riser bar 40 may be raised or lowered electrically with the aid of a reversible electric motor 56 and a control switch 58, as shown in FIG. 4.

The bow 32 is then pressed by further lowering the riser bar 40 to lower the first and second handle rollers 20, 30 in relation to the first and second limb rollers 64, 74. This further compresses the bow 32 to allow the bow string 38 to be easily installed or removed, and to check for alignment of the rollers and cams which are positioned at the distal ends 32A and 32B of the bow 32.

Upon completion of work on the bow 32, the jack mechanism 50 is moved in the opposite direction to raise the vertical riser bar 40, which in turn raises the inclined riser beam 10, which relieves pressure on the bow 32. Once the first and second handle rollers 20, 30 clear the bow handle portion 36, the bow 32 may be easily removed from the bow press 100 in preparation for work on the next bow 32.

The inclined ends 14, 16 of the inclined riser beam 10 are positioned to avoid articles secured in proximity to the handle 36 of the bow 32, which would interfere with a straight riser beam 10, typically found on other types of bow press equipment.

The invention being thus described, it will be evident that the same may be varied in many ways. Such variations are not to be regarded as a departure from the spirit and scope of the invention and all such modifications are intended to be included within the scope of the claims.

PARTS LIST

100—Bow Press
10—inclined riser beam
12—spaced apertures
14—left end
16—right end
20—first handle roller
22—axle
24—first inclined side portions
26—second inclined side portions
28—inclined handle groove
30—second handle roller
31—roller boot
32—user's bow
34—bow arms
35—bow end apparatus
36—handle portion
38—bow string
40—vertical riser bar
45—gear
48—teeth
50—jack mechanism
52—jack handle
54—jack housing
56—reversible electric motor
58—switch
59—electrical wiring
60—base member
62—left mounting portion
64—right mounting portion
70—left inclined spacer bar
72—slidable base portion
74—first limb roller
76—tensioning member
78—handle
80—right inclined spacer bar
82—slidable base portion
84—second limb roller
90—first upstanding leg member
92—second upstanding leg member
94—first leg base portion
95—mounting aperture
96—second leg base portion
97—fastening means
98—cross brace
200—bow press legs

I claim:

1. An adjustable bow press for use with a plurality of user's bows, comprising:

a) a rectangular base member, having opposing mounting brackets located on each end, to secure the rectangular base member to a rigid surface;

b) an outwardly inclined left spacer bar having a slidable base portion adjustably positioned upon the base member and releasably secured thereto with a first tensioning member;

c) an outwardly inclined right spacer bar having a slidable base portion adjustably positioned upon the base member and releasably secured thereto with a second tensioning member;

d) a vertical riser bar adjustably positioned between said left spacer bar and said right spacer bar, said riser bar having a plurality of teeth extending vertically thereon;

e) an inclined riser beam centrally secured to an upper end of the riser bar, the inclined riser beam having an upwardly inclined left side and an upwardly inclined right side, the inclined riser beam with a plurality of apertures horizontally extending in spaced relation along the inclined left side and the inclined right side of the inclined riser beam;

e) a jack mechanism having at least one gear within a gear housing, the gear housing secured to the base member, the riser bar extending from the gear housing, the gear engagable with the plurality of teeth on the riser bar, the jack mechanism with a jack handle for manually rotating the gear to selectively raise and lower the riser bar;

f) a first limb roller rotatably secured to the upper end of the left spacer bar;

g) a second limb roller rotatably secured to the upper end of the right spacer bar;

h) a first handle roller adjustably positioned and rotatably secured to the left side of the inclined riser beam;

i) a second handle roller adjustably positioned and rotatably secured to the right side of the inclined riser beam; wherein the first and second limb roller are adjusted in width to suit a selected user's bow limbs, by adjustably positioning and releasably securing the left spacer bar and the right spacer bar upon the base member; and the first and second handle rollers are adjustably positioned and releasably secured in a selected aperture in the inclined riser beam to selectively control the width between the first and second handle rollers upon the inclined riser beam, and the riser bar is adjustably positioned vertically by said jack mechanism to adjustably position the first and second handle rollers in relation to the first and second limb rollers, to controllably position and flex a selected user's bow when placed in the bow press, for ease of maintenance and repair.

2. The adjustable bow press apparatus of claim 1, wherein the first and second limb rollers each have an axle sized to be rotatably received in an aperture in one of the said left and right spacer bars, and the first and second handle rollers each have an axle sized to be rotatably received in a selected aperture in said inclined riser beam; and each of the first and second limb rollers and each of the first and second handle rollers have a first inclined side portion and a second inclined side portion, the first and second inclined side portions to form an inclined groove extending therebetween.

3. The adjustable bow press apparatus of claim 2, wherein a roller boot is installed in the inclined groove located between the first inclined side portion and the second inclined side portion of the first and second limb rollers to cushion and protect the user's bow from damage or discoloration during use upon the adjustable bow press apparatus.

4. The adjustable bow press apparatus of claim 1, wherein a first bow press leg and a second bow press leg are secured to the opposing brackets on the base member to support the adjustable bow press above the floor, said bow press legs each having a leg base portion for supporting the upstanding leg members, with a cross brace extending between the first and second bow press legs in spaced relation between the opposing brackets on the base member, and the respective leg base portions.

5. The adjustable bow press apparatus of claim 4, wherein mounting apertures are provided in the first and second leg portions of the first and second upstanding leg members, to receive a suitable fastening means to securely mount the bow press to the floor.

6. The adjustable bow press apparatus of claim 1, wherein the tensioning members are handles with an externally threaded shaft having a distal end, which is adjustably secured in a complimentary threaded aperture in the slidable base portion of the respective left and right spacer bars, and wherein the distal end of the threaded shaft abuts the base member to releasably secure the slidable base portion of the respective left and right spacer bars to the base member.

7. The adjustable bow press apparatus of claim 1, wherein the left and right spacer bars are inclined outwardly from the slidable base portion of the respective left and right spacer bars, and a gusset is secured between the respective spacer bar and said slidable base portion to strengthen and support the respective left and right spacer bars above the base member.

8. The adjustable bow press apparatus of claim 1, wherein the left and right spacer bars are positioned and aligned with a user's bow limbs, the user's bow limbs are then placed upon the first and second limb rollers located upon the left and right spacer bars, and the inclined riser beam is adjusted in width to align with the user's bow handle, and the inclined riser beam is lowered with the jack mechanism to engage the first and second handle rollers upon the user's bow handle, to flex the user's bow for ease of maintenance and repair, while the inclined riser beam provides clearance for various objects secured to said handle of said bow.

9. The adjustable bow press of claim 1, wherein the jack mechanism comprises a gear which is electrically rotated by a reversible electric motor, and controlled by an on-off switch connected to a remote electrical power supply.

10. An adjustable bow press for use with a plurality of user's bows, comprising:

a) a rectangular base member, having opposing mounting brackets located on each end, to secure the rectangular base member to a rigid surface;

b) an outwardly inclined left spacer bar having a slidable base portion adjustably positioned upon the base member and releasably secured thereto with a first tensioning member;

c) an outwardly inclined right spacer bar having a slidable base portion adjustably positioned upon the base member and releasably secured thereto with a second tensioning member;

d) a vertical riser bar adjustably positioned between said left spacer bar and said right spacer bar, said riser bar having a plurality of teeth extending vertically thereon;

e) an inclined riser beam centrally secured to an upper end of the riser bar, the inclined riser beam having an upwardly inclined left side and an upwardly inclined right side, the inclined riser beam with a plurality of apertures horizontally extending in spaced relation along the inclined left side and the inclined right side of the inclined riser beam;

e) a jack mechanism having at least one gear within a gear housing, the gear housing secured to the base member, the riser bar extending from the gear housing, the gear engagable with the plurality of teeth on the riser bar, the jack mechanism with a jack handle for manually rotating the gear to selectively raise and lower the riser bar;

f) a first limb roller rotatably secured to the upper end of the left spacer bar and a second limb roller rotatably secured to the upper end of the right spacer bar; the first and second limb rollers each have an axle sized to be rotatably received in an aperture in one of the said left and right spacer bars;

h) a first handle roller adjustably positioned and rotatably secured to the left side of the inclined riser beam and a second handle roller adjustably positioned and rotatably secured to the right side of the inclined riser beam, the first and second handle rollers each have an axle sized to be rotatably received in a selected aperture in said inclined riser beam; and the first and second limb rollers and the first and second handle rollers each have a first inclined side portion and a second inclined side portion, the first and second inclined side portions to form an inclined groove extending therebetween;

wherein the left and right spacer bars are positioned and aligned with the limbs of a user's bow, the user's bow limbs are then placed upon the first and second limb rollers located upon the left and right spacer bars, and the inclined riser beam is adjusted in width to align with the user's bow handle, and the inclined riser beam is lowered with the jack mechanism to engage the first and second handle rollers upon the user's bow handle, to flex the user's bow for ease of maintenance and repair, while the inclined riser beam provides clearance for various objects secured to said handle of said bow.

11. The adjustable bow press apparatus of claim 10, wherein a roller boot is installed in the inclined groove located between the first inclined side portion and the second inclined side portion of the first and second limb rollers to cushion and protect the user's bow from damage or discoloration during use upon the adjustable bow press apparatus.

12. The adjustable bow press apparatus of claim 10, wherein a first bow press leg and a second bow press leg are mounted to the opposing brackets on the base member to support the adjustable bow press above the floor, said bow press legs each have a leg base portion for supporting the upstanding leg members, with a cross brace extending between the first and second bow press legs in spaced relation between the opposing brackets on the base member, and the respective leg base portions.

13. The adjustable bow press apparatus of claim 10, wherein mounting apertures are provided in the first and second leg portions of the first and second upstanding leg members, to receive a suitable fastening means to securely mount the bow press to the floor.

14. The adjustable bow press apparatus of claim 10, wherein the tensioning members are handles with an externally threaded shaft having a distal end, which is adjustably secured in a complimentary threaded aperture in the slidable base portion of the respective left and right spacer bars, and wherein the distal end of the threaded shaft abuts the base member to releasably secure the slidable base portion of the respective left and right spacer bars to the base member.

15. The adjustable bow press apparatus of claim 10, wherein the left and right spacer bars are inclined outwardly from the slidable base portion of the respective left and right spacer bars, and a gusset is secured between the respective spacer bar and said slidable base portion to strengthen and support the respective left and right spacer bars above the base member.

16. The adjustable bow press of claim 10, wherein the jack mechanism gear is electrically rotated by a reversible electric motor, and controlled by an on-off switch connected to a remote electrical power supply.

17. An adjustable bow press for use with a plurality of user's bows, comprising:

a) a rectangular base member, having opposing mounting brackets located on each end, to secure the rectangular base member to a rigid surface;

b) an outwardly inclined left spacer bar having a slidable base portion adjustably positioned upon the base member and releasably secured thereto with a first tensioning member and an outwardly inclined right spacer bar having a slidable base portion adjustably positioned upon the base member and releasably secured thereto with a second tensioning member, said left and right spacer bars are inclined outwardly from the slidable base portion of the respective left and right spacer bars, and a gusset is secured between the respective spacer bar and said slidable base portion to strengthen and support the respective left and right spacer bars above the base member;

c) a vertical riser bar adjustably positioned between said left spacer bar and said right spacer bar, said riser bar having a plurality of teeth extending vertically thereon;

d) an inclined riser beam centrally secured to an upper end of the riser bar, the inclined riser beam having an upwardly inclined left side and an upwardly inclined right side, the inclined riser beam with a plurality of apertures horizontally extending in spaced relation along the inclined left side and the inclined right side of the inclined riser beam;

e) a jack mechanism having at least one gear within a gear housing, the gear housing secured to the base member, the riser bar extending from the gear housing, the gear engagable with the plurality of teeth on the riser bar, the jack mechanism with a jack handle for manually rotating the gear to selectively raise and lower the riser bar;

f) a first limb roller rotatably secured to the upper end of the left spacer bar and a second limb roller rotatably secured to the upper end of the right spacer bar; the first and second limb rollers each have an axle sized to be rotatably received in an aperture in one of the said left and right spacer bars;

g) a first handle roller adjustably positioned and rotatably secured to the left side of the inclined riser beam and a second handle roller adjustably positioned and rotatably secured to the right side of the inclined riser beam, the first and second handle rollers each have an axle sized to be rotatably received in a selected aperture in said inclined riser beam; and the first and second limb rollers and the first and second handle rollers each have a first inclined side portion and a second inclined side portion, the first and second inclined side portions to form an inclined groove extending therebetween;

wherein the left and right spacer bars are positioned and aligned with the limbs of a user's bow, the user's bow limbs are then placed upon the first and second limb rollers located upon the left and right spacer bars, and the inclined riser beam is adjusted in width to align with the user's bow handle, and the inclined riser beam is lowered with the jack mechanism to engage the first and second handle rollers upon the user's bow handle, to flex the user's bow for ease of maintenance and repair, while the inclined riser beam provides clearance for various objects secured to said handle of said bow.

18. The adjustable bow press apparatus of claim 17, wherein a roller boot is installed in the inclined groove located between the first inclined side portion and the second inclined side portion of the first and second limb rollers to cushion and protect the user's bow from damage or discoloration during use upon the adjustable bow press apparatus.

19. The adjustable bow press apparatus of claim 17, wherein a first bow press leg and a second bow press leg are mounted to the opposing brackets on the base member to support the adjustable bow press above the floor, said bow press legs each have a leg base portion for supporting the upstanding leg members, and mounting apertures are provided in the first and second leg portions of the first and second upstanding leg members, to receive a suitable fastening means to securely mount the bow press to the floor, and a cross brace secured between the first and second bow press legs in spaced relation between the opposing brackets on the base member, and the respective leg base portion.

20. The adjustable bow press of claim 17, wherein the jack mechanism gear is electrically rotated by a reversible electric motor, and controlled by an on-off switch connected to a remote electrical power supply.

* * * * *